US006149139A

United States Patent [19]

Holderle

[11] Patent Number: 6,149,139

[45] Date of Patent: Nov. 21, 2000

[54] MEMBRANE CARBURETOR FOR A PORTABLE HANDHELD WORK APPARATUS

[75] Inventor: Hans Holderle, Freiberg am Neckar, Germany

[73] Assignee: Andreas Stihl AG & Co., Waiblingen, Germany

[21] Appl. No.: 09/217,835

[22] Filed: Dec. 22, 1998

[30] Foreign Application Priority Data

Dec. 24, 1997 [DE] Germany ..... 297 22 869 U

[51] Int. Cl.[7] ..... F02M 17/04

[52] U.S. Cl. ..... 261/35; 137/533; 261/69.1; 261/DIG. 39; 261/DIG. 68

[58] Field of Search ..... 261/35, 69.1, DIG. 8, 261/DIG. 38, DIG. 68, DIG. 39; 251/333; 137/533

[56] References Cited

U.S. PATENT DOCUMENTS

| | | | |
|---|---|---|---|
| 3,065,957 | 11/1962 | Phillips | 261/35 |
| 3,085,791 | 4/1963 | Phillips | 261/35 |
| 4,001,354 | 1/1977 | Tuckey | 261/DIG. 68 |
| 4,104,994 | 8/1978 | Phillips | 261/35 X |
| 4,931,226 | 6/1990 | Ishii | 261/DIG. 68 |
| 5,002,705 | 3/1991 | Kohler | 261/DIG. 38 |
| 5,034,163 | 7/1991 | Baltz et al. | 261/DIG. 38 |
| 5,283,013 | 2/1994 | Gerhardy | 261/35 |
| 5,441,673 | 8/1995 | Gerhardy | 261/35 X |
| 5,681,508 | 10/1997 | Gerhardy | 261/35 |

FOREIGN PATENT DOCUMENTS

| | | | |
|---|---|---|---|
| 1526754 | 1/1970 | Germany . | |
| 1949997 | 5/1970 | Germany . | |
| 1751142 | 9/1970 | Germany . | |
| 4328989 | 3/1995 | Germany . | |
| 19504400 | 8/1996 | Germany | 261/35 |
| 47-38331 | 9/1972 | Japan . | |
| 56-97546 | 9/1981 | Japan . | |
| 6173054 | 5/1986 | Japan . | |
| 2-171564 | 7/1990 | Japan . | |

*Primary Examiner*—Richard L. Chiesa
*Attorney, Agent, or Firm*—Walter Ottesen

[57] ABSTRACT

The invention relates to a membrane carburetor for an internal combustion engine in a portable handheld work apparatus such as a motor-driven chain saw. A throttle flap is arranged in the intake channel for the combustion air. The throttle flap is pivotally journalled downstream of a venturi section of the intake channel. A main nozzle for supplying fuel from a fuel-filled control chamber of the carburetor is provided in the region of the venturi section. The control chamber is delimited by a membrane which actuates a control valve controlling the fuel inflow into the control chamber. The main nozzle includes a check valve which includes a valve seat with a valve platelet assigned thereto. In order to avoid a dripping of the main nozzle even under unfavorable operating conditions, a sieve platelet is provided which effects an additional capillary sealing of the main nozzle during idle. The sieve platelet substantially completely covers the outlet cross section of the main nozzle downstream of the check valve.

12 Claims, 3 Drawing Sheets

MEMBRANE CARBURETOR FOR A PORTABLE HANDHELD WORK APPARATUS

FIELD OF THE INVENTION

The invention relates to a membrane carburetor for an internal combustion engine in a portable handheld work apparatus such as a motor-driven chain saw.

BACKGROUND OF THE INVENTION

Known membrane carburetors of the above kind include a housing having an intake channel in which a venturi section is formed. An idle nozzle and a main nozzle open into the intake channel. These nozzles supply fuel from a control chamber. The idle output openings lie downstream of the venturi section in the region of the throttle flap. The main nozzle exit opening lies in the region of the venturi section upstream of the throttle flap. In the case of idle, main nozzle drip can occur because of vibrations as well as because of the pulsating gas mixture in the intake channel. This can lead to an enrichment of the mixture and the idle fluctuations associated therewith. For this reason, a check valve is provided in the fuel tank of the main nozzle at the end next to the intake channel. This check valve comprises a valve platelet, which is provided in a valve chamber, and a valve seat assigned thereto. The valve platelet mechanically closes the main nozzle path in the case of idle so that pressure pulsations in the intake channel do not operate on the control chamber via the main nozzle path. Under unfavorable conditions, main nozzle drip occurs nonetheless in individual cases which can lead to an overenrichment of the mixture and a stalling of the engine.

SUMMARY OF THE INVENTION

It is an object of the invention to provide a membrane carburetor which is so configured that even under unfavorable conditions, effects on the idle system as well as a dripping of the main nozzle are reliably avoided. Air can be inducted into the control chamber because of non-tightness of the check valve and this can lead to a leaning of the idle mixture and therefore to a stalling of the engine.

The membrane carburetor of the invention is for an internal combustion engine in a portable handheld work apparatus including a motor-driven chain saw, cutoff machine and brushcutter. The membrane carburetor includes: a carburetor housing defining an intake channel communicating with the engine and through which a stream of combustion air flowing in an intake flow direction is drawn by suction when the engine is operating; the intake channel defining a venturi section; a throttle flap pivotally mounted in the intake channel downstream of the venturi section; the carburetor housing further defining an interior space; a control membrane mounted in the interior space so as to define a control chamber therein bounded by the membrane; fuel supply means for supplying fuel to the control chamber; a main nozzle for metering fuel from the control chamber and the main nozzle opening into the intake channel in the region of the venturi section; the fuel supply means including a control valve for controlling the inflow of the fuel to the control chamber; the control membrane being operatively connected to the control valve for actuating the control valve; the main nozzle having an outlet cross section through which the fuel passes when entering the intake channel; the main nozzle having a check valve defining a valve chamber through which fuel passes as the fuel flows to the outlet cross section; the check valve including a valve seat in the valve chamber and a valve platelet coacting with the valve seat to open and close the check valve; and, a sieve platelet disposed downstream of the valve seat and the valve platelet and arranged so as to substantially completely cover the outlet cross section.

The sieve platelet substantially completely covers the outlet cross section of the main nozzle downstream of the check valve. In the case of idle, an additional capillary sealing of the fuel tank of the main nozzle is achieved via the sieve platelet. In the case of idle, the check valve of the main nozzle (at the end toward the intake channel) is mechanically closed and the valve chamber is additionally sealed by the capillary sealing of the sieve platelet so that pressure fluctuations cannot operate directly on the valve platelet. Even under unfavorable operating conditions, this ensures a mechanically tight closure of the check valve so that neither a main-nozzle drip nor an intake of air or other adverse effects could be determined on the idle system. Only with the buildup of an underpressure (which overcomes the capillary forces) on the side of the sieve platelet, which is lightly stroked by the flowing combustion air, is a fuel flow possible from the control chamber into the intake channel.

Preferably, the sieve platelet together with the check valve is fixed in the nozzle housing. It has been shown to be advantageous to reinforce the edge of the sieve platelet.

The sieve platelet has a mesh width of 20 to 80 $\mu$m and the mesh width is preferably 40 to 60 $\mu$m.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
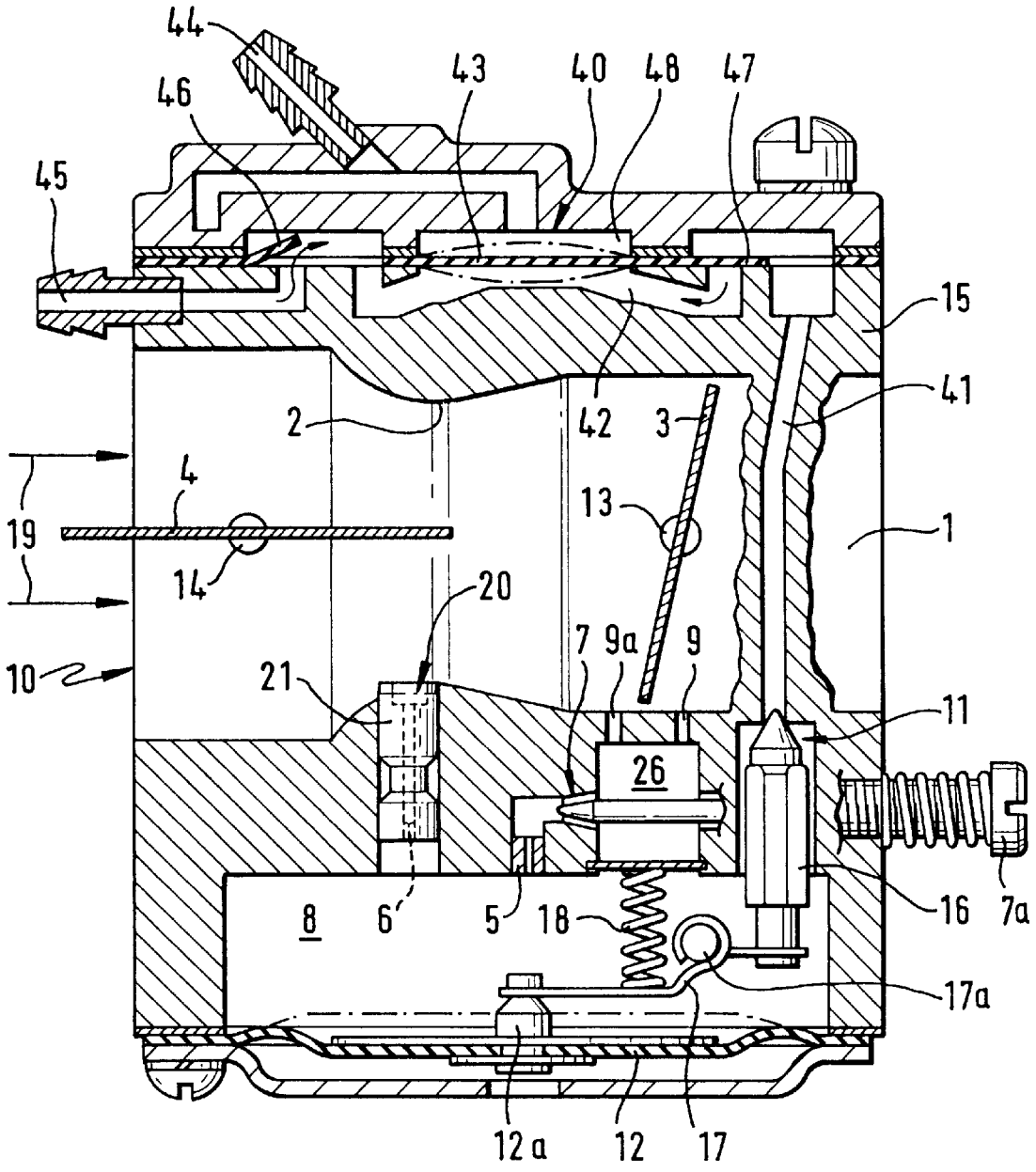
FIG. 1 is a section view through a membrane carburetor having a main nozzle according to a feature of the invention.
Figure 2:
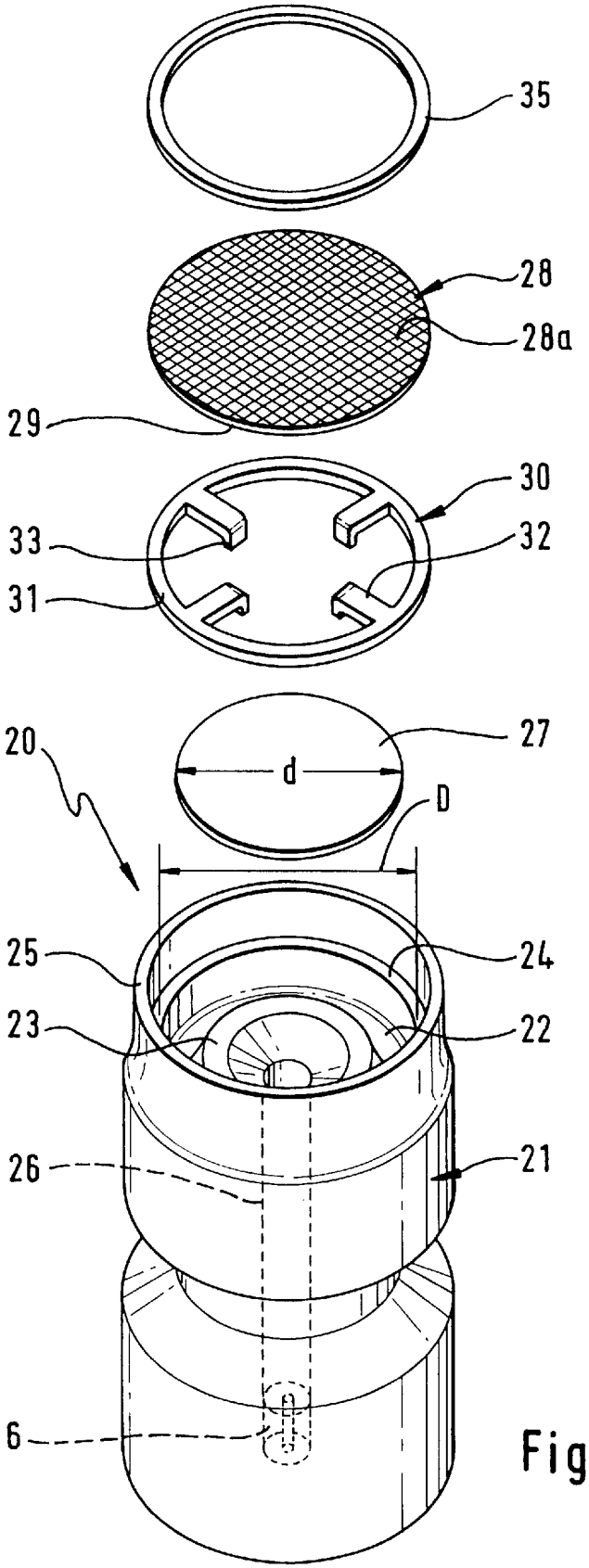
FIG. 2 is an exploded view of the main nozzle of FIG. 1.

The membrane carburetor shown in FIG. 1 is provided on a internal combustion engine in a portable handheld work apparatus such as a motor-driven chain saw, a cutoff machine, a brushcutter or the like. The internal combustion engine can be a two-stroke engine, a four-stroke engine or the like.

As shown in the section view of FIG. 1, the membrane carburetor includes a housing 15 having a through intake channel 10 formed in the housing. In the housing 15, a fuel pump 40 is also configured as well as a fuel-filled control chamber 8.

A throttle flap 3 is pivotally held by means of a pivot pin 13 in the intake channel 10. The throttle flap 3 is located downstream of a venturi section 2 viewed in the flow direction 19 of the combustion air. A choke flap 4 is pivotally mounted with a pivot pin 14 in the intake channel 10 and is located upstream of the venturi section 2. Idle outlet openings 9 and **9*a* are formed in the wall of the intake channel 10 in the region of the throttle flap 3. The idle outlet openings 9 and 9*a* are supplied with fuel from the fuel-filled control chamber 8 via an idle nozzle 7 adjustable with an idle screw 7***a*. A fixed throttle 5 is mounted in the flow path to the idle nozzle 7 and this throttle limits the maximum fuel flow into the idle system.

The main nozzle 20 for the incoming fuel is arranged in the venturi section 2 upstream of the throttle flap 3 and downstream of the choke flap 4. Here too, it is advantageous to arrange a fixed throttle 6 in the flow path from the control chamber 8 to the main nozzle 20 in order to limit the maximum fuel flow.

The fuel-filled control chamber 8 is delimited by a control membrane 12 having a center 12*a* which lies on one end of a two-arm lever 17. The lever 17 is held on a pivot bearing 17*a* fixedly mounted in the control chamber 8. A valve body 16 of a control valve 11 is held on the other arm of the lever 17. The control valve 11 controls a feed channel 41 extending from the fuel pump 40 to the control chamber 8. The lever 17 is biased by a control spring 18 in the sense of a closure of the control valve 11.

A compensating chamber is configured on the side of the membrane 12 facing away from the control chamber 8. The compensating chamber communicates with the atmosphere via an opening.

The fuel is supplied to the control chamber 8 via the feed channel 41 and the control valve 11. The fuel is supplied by the fuel pump 40 via a fuel line 45 from a fuel tank (not shown). The fuel pump 40 comprises a pump chamber 42 delimited by a work membrane 43. Check valves 46 and 47 are provided on the input end and output end of the fuel chamber 42. The check valves (46, 47) open in the flow direction of the fuel. A pressure drive chamber 48 is formed at the side of the membrane 43 facing away from the pump chamber 42. The pressure drive chamber is connected via a pressure connection 44 to a fluctuating pressure source such as the crankcase of the internal combustion engine.

When the engine is operating, the changing crankcase pressure effects the drive of the fuel pump 40 which makes available fuel under pressure to the control chamber 8 via the feed channel 41. The control spring 18 holds the control valve 11 closed against the fuel pressure as long as the pressure in the control chamber 8 is balanced. In the idle mode of the engine, fuel exits from the idle nozzle 9 because of the underpressure effective in the intake channel downstream of the throttle flap 3. In the full-load case, the fuel exits from both idle outlet openings 9 and 9*a* as well as from the main nozzle 20 into the intake channel 10 when the throttle flap 3 is open. Because of the fuel which exits from the idle outlet openings (9, 9*a*) and the main nozzle 20, an underpressure builds up in the control chamber 8 and the membrane moves inwardly as shown by the position thereof in phantom outline whereby the lever 17 pivots and the control valve 11 is opened. Fuel flows into the control chamber 8 until the pressure is again balanced and the control valve 11 is closed.

Figure 3:
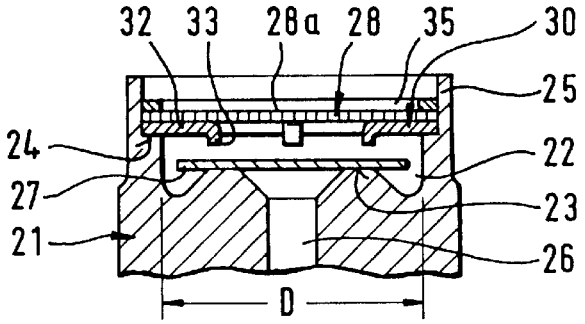
FIG. 3 is a detailed view, in section, taken through a portion of the main nozzle of FIG. 2 shown with an end ring.
Figure 4:
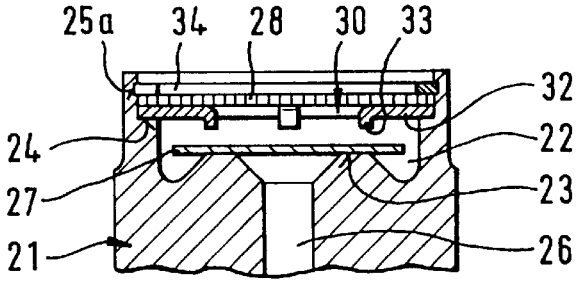
FIG. 4 is a detailed view, in section, through the nozzle of FIG. 2 equipped with a holding ring.

The main nozzle 20 is configured with a check valve as shown in FIGS. 3 and 4 in order to ensure (for the idle position shown) that fuel enters into the intake channel 10 exclusively via the idle outlet openings. The check valve includes a valve seat 23 and a valve platelet 27 assigned to the valve seat 23. The check valve is provided in the end of a nozzle housing 21, that is, the end at the intake channel side. The nozzle housing 21 is configured as a component separate from the membrane carburetor 1. In the embodiment shown, the nozzle housing 21 is essentially a cylindrical turned part which is seated in a corresponding receiving bore in the wall of the intake channel 10 of the membrane carburetor 1. The nozzle housing 21 includes an axial through-extending fuel channel 26 having an end facing toward the control chamber 8. The fixed throttle 6 is seated at this end which faces toward the control chamber 8. At the end facing toward the intake channel 10, the fuel channel 26 widens into a valve chamber 22. The valve seat 23 surrounds the opening of the fuel channel 26 at the valve chamber 22. The valve platelet 27 preferably comprises TEFLON material (polytrafluoroethylene) and lies loosely in the valve chamber 22 with radial play. The diameter (d) of the valve platelet 27 is so dimensioned to the inner diameter D of the valve chamber 22 that an overlapping of the valve seat 23 is ensured in each position of the valve platelet 27 in the valve chamber 22.

The position of the valve platelet 27 is determined by a retainer 30 in the open position of the check valve 23/27. The retainer essentially comprises an outer ring 31 having radial arms 32 uniformly distributed over the inner periphery. In the embodiment shown, the outer ring 31 has four radial arms 32 lying at a spacing of 90° one to the other. The outer ends of the radial arms 32 are bent over toward the valve platelet 27 and each defines a support section 33. The outer ring 31 of the retainer 30 lies on an annular surface 24 which is formed on a widened end section on a step of the valve chamber 22. The end section has a small cylindrical outer edge 25 which extends beyond the retainer 30.

A sieve platelet 28 is placed on the retainer 30. The retainer 30 supports the valve platelet 27 in its open position and defines a support for the sieve platelet 28. The radial arms 32 mechanically support the mesh of the sieve platelet.

Figure 5:
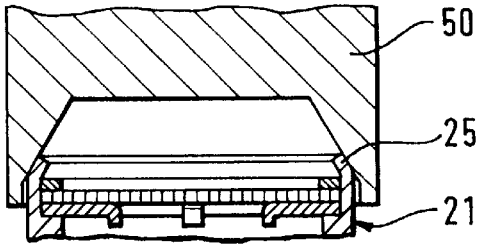
FIG. 5 shows a first work step for flanging the edge of the nozzle housing; and, FIG. 6 shows a second work step for flanging the edge of the nozzle housing.
Figure 6:
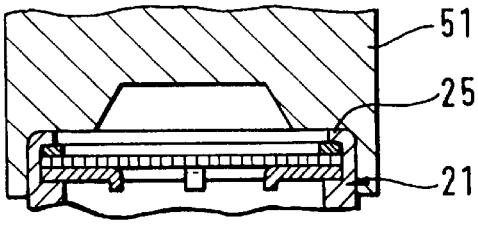

In the embodiment of FIG. 3, an end ring 35 is placed on the sieve platelet 28. The sieve platelet 28 is preferably configured without an edge and the end ring 35 reinforces the sieve plate in the region of its edge 29. The edge 29 of the sieve platelet 28 is therefore reinforced by the end ring 35 on the side 28*a* of the sieve platelet facing toward the intake channel 10 and is reinforced on the side facing toward the valve platelet 27 by the outer ring 31 of the retainer 30. The elevation of the outer edge 25 is so selected that the latter projects beyond the retainer 30, the sieve platelet 28 and the end ring 35. The projecting end section of the outer edge 25 is flanged over in two steps utilizing flanging tools (50, 51) as shown in FIGS. 4 and 5. In the first step shown in FIG. 5, the end portion of the cylindrical outer edge is pressed inwardly by the flanging tool 50 and is thereafter completely flanged over in a second work step shown in FIG. 6 utilizing a second flanging tool 51. In this way, the valve platelet 27, the retainer 30 and the sieve platelet 28 with the end ring 35 are together held in a form-tight manner by the bent-over edge 25 of the nozzle housing.

It can be sufficient to utilize a slit retaining ring 34 in lieu of the end ring 35. The retaining ring 34 is held under radial tension in the extended end section 25*a* in the manner of a lock ring 34 and fixes the retainer 30 as well as the sieve plate 28 in their position on the angular surface 24. Flanging of the edge is then unnecessary.

The sieve platelet comprises a sieve mesh having a mesh size of 20 to 80 $\mu$m. The mesh size is preferably 40 to 60 $\mu$m. The sieve platelet is made of a plastic which is resistant to fuel, steel or like material. If the sieve platelet 28 is made of plastic, then the edge 29 thereof can be reinforced and configured as one piece with the sieve platelet. The sieve platelet is preferably configured without an edge when the sieve platelet is made of metal.

As shown in FIG. 3, the sieve platelet 28 completely covers the outlet cross section of the main nozzle 20 downstream of the check valve whereby a mechanical closing of the fuel channel 26 of the main nozzle 20 is achieved on the one hand via the valve platelet 27 (coacting with valve seat 23) and, simultaneously, a capillary seal of the main nozzle 20 is provided by the residual fuel remaining in the mesh openings of the sieve platelet 28.

The side 28*a* of the sieve platelet 28 faces away from the check valve (23, 27) and faces toward the intake channel 10. The side 28*a* lies approximately at the elevation of the channel walls of the intake channel 10 and is directly stroked by the combustion air 19 whereby the fuel, which is capillarily held in the mesh openings of the sieve platelet 28, is entrained. The underpressure of the venturi section, which is present at the main nozzle 20, leads to an opening of the check valve (23, 27). The valve platelet 27 lifts from the valve seat 23 and fuel flows from the control chamber 8 via the fuel channel 26 into the intake channel 10.

Essentially atmospheric pressure is present at the main nozzle 20 if the throttle flap is in the idle position shown in FIG. 1. Only a small quantity of combustion air 19 flows through the intake channel 10 to the internal combustion engine. The residual fuel, which is capillarily held in the mesh openings of the sieve platelet 28, seals the outlet opening of the main nozzle 20 downstream of the check valve (23, 27). Dripping at the main nozzle is substantially avoided even when there are intense vibrations which could effect a lifting of the valve platelet 27 from the valve seat.

It is understood that the foregoing description is that of the preferred embodiments of the invention and that various changes and modifications may be made thereto without departing from the spirit and scope of the invention as defined in the appended claims.

What is claimed is:

1. A membrane carburetor for an internal combustion engine in a portable handheld work apparatus including a motor-driven chain saw, cutoff machine and brushcutter, the membrane carburetor comprising:

a carburetor housing defining an intake channel communicating with the engine and through which a stream of combustion air flowing in an intake flow direction is drawn by suction when the engine is operating;

said intake channel defining a venturi section;

a throttle flap pivotally mounted in said intake channel downstream of said venturi section;

said carburetor housing further defining an interior space;

a control membrane mounted in said interior space so as to define a control chamber therein bounded by said membrane;

fuel supply means for supplying fuel to said control chamber;

a main nozzle for metering fuel from said control chamber and said main nozzle opening into said intake channel in the region of said venturi section;

said fuel supply means including a control valve for controlling the inflow of said fuel to said control chamber;

said control membrane being operatively connected to said control valve for actuating said control valve;

said main nozzle having an outlet cross section through which the fuel passes when entering said intake channel;

said main nozzle having a check valve defining a valve chamber through which fuel passes as the fuel flows to said outlet cross section;

said check valve including a valve seat in said valve chamber and a valve platelet coacting with said valve seat to open and close said check valve; and, a sieve platelet disposed downstream of said valve seat and said valve platelet and arranged so as to substantially completely cover said outlet cross section.

2. The membrane carburetor of claim 1, said sieve platelet having a side facing away from said valve platelet; and, said sieve platelet being disposed in said main nozzle so as to be stroked by said combustion air moving through said intake channel.

3. The membrane carburetor of claim 2, said check valve including a retainer disposed above said valve platelet for supporting said valve platelet in the open position thereof; and, said retainer also defining a support surface for said sieve platelet.

4. The membrane carburetor of claim 3, said retainer having an outer ring configured as a reinforcing edge of said sieve platelet.

5. The membrane carburetor of claim 4, said sieve platelet having an outer edge and said check valve further including an end ring placed on said sieve platelet to reinforce said outer edge thereof.

6. The membrane carburetor of claim 5, said sieve platelet having a mesh size or mesh aperture of 20 $\mu$m to 80 $\mu$m.

7. The membrane carburetor of claim 5, said sieve platelet having a mesh size or mesh aperture of 40 $\mu$m to 60 $\mu$m.

8. The membrane carburetor of claim 4, said sieve platelet having a reinforcing edge and said sieve platelet being configured as a single piece with said reinforcing edge.

9. The membrane carburetor of claim 4, said sieve platelet being configured without an edge.

10. The membrane carburetor of claim 1, further comprising a check valve assembly including said check valve and a nozzle housing for accommodating both said check valve and said sieve platelet therein and being configured as a component separate from said membrane carburetor.

11. The membrane carburetor of claim 10, said nozzle housing having an edge projecting beyond said sieve platelet; said edge being flanged over to hold said valve platelet, said retainer and said sieve platelet in said nozzle housing.

12. The membrane carburetor of claim 10, said nozzle housing having an edge portion projecting beyond said sieve platelet and said check valve assembly further including a retaining ring mounted in said edge portion for holding said valve platelet, said retainer and said sieve platelet in said nozzle housing.

* * * * *